US010240558B2

(12) United States Patent
Loew et al.

(10) Patent No.: US 10,240,558 B2
(45) Date of Patent: Mar. 26, 2019

(54) PISTON FOR A TWO-STROKE ENGINE WORKING WITH ADVANCED SCAVENGING AND A TWO-STROKE ENGINE

(71) Applicant: Andreas Stihl AG & Co. KG, Waiblingen (DE)

(72) Inventors: Birger Loew, Wernau (DE); Jonas Lank, Winnenden (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 15/682,357

(22) Filed: Aug. 21, 2017

(65) Prior Publication Data

US 2018/0051650 A1 Feb. 22, 2018

(30) Foreign Application Priority Data

Aug. 19, 2016 (EP) ..... 16001825

(51) Int. Cl.
*F02B 33/04* (2006.01)
*F02F 3/24* (2006.01)
*F02F 3/00* (2006.01)

(52) U.S. Cl.
CPC ..... *F02F 3/24* (2013.01); *F02F 3/0076* (2013.01)

(58) Field of Classification Search
CPC ..... F02F 3/24; F02F 3/0076
USPC ..... 123/193.6, 73 PP
See application file for complete search history.

(56) References Cited

U.S. PATENT DOCUMENTS

| | | | | |
|---|---|---|---|---|
| 5,979,391 | A | 11/1999 | Ulrich et al. | |
| 7,406,941 | B2 | 8/2008 | Zhu et al. | |
| 8,616,164 | B2 * | 12/2013 | Kunert | F02B 25/14 123/193.6 |
| 8,899,194 | B2 | 12/2014 | Engel | |
| 2007/0113734 | A1 * | 5/2007 | Haussermann | B23B 31/16275 92/208 |
| 2010/0147252 | A1 | 6/2010 | Langner et al. | |
| 2011/0197868 | A1 | 8/2011 | Engel | |
| 2013/0192556 | A1 | 8/2013 | Rothkegel | |
| 2014/0182571 | A1 * | 7/2014 | Takayanagi | F02B 43/02 123/73 PP |

(Continued)

FOREIGN PATENT DOCUMENTS

| | | | |
|---|---|---|---|
| JP | S55170440 | U | 12/1980 |
| JP | S6055753 | A | 4/1985 |

(Continued)

*Primary Examiner* — Marguerite McMahon
(74) *Attorney, Agent, or Firm* — Walter Ottesen, P.A.

(57) ABSTRACT

A piston for a two-stroke engine operating with advanced scavenging has a piston base and a piston skirt. The piston has a piston pocket which has a smallest distance (e) from a top side of the piston base. The piston has a section plane perpendicularly to the longitudinal center axis of the piston, the distance of which section plane from the top side of the piston base is greater than the smallest distance (e). A middle plane of the piston intersects the piston skirt at a location. In the circumferential direction between the pocket and this location, a thickened area is arranged in the section plane, the greatest wall thickness of which area is at least 1.1 times the wall thickness at the location. The piston has an edge at a recess at which the piston skirt has a reduced height. A chamfer is arranged on the radially outer side of the piston.

21 Claims, 6 Drawing Sheets

(56) References Cited

U.S. PATENT DOCUMENTS

| | | | | |
|---|---|---|---|---|
| 2015/0059682 | A1 | 3/2015 | Weinenger | |
| 2015/0198114 | A1 | 7/2015 | Zauner et al. | |
| 2016/0097344 | A1* | 4/2016 | Yamazaki ..... | F02B 25/02<br>123/73 PP |

FOREIGN PATENT DOCUMENTS

| | | | |
|---|---|---|---|
| JP | H03119553 | U | 12/1991 |
| JP | H08117917 | A | 5/1996 |

* cited by examiner

PISTON FOR A TWO-STROKE ENGINE WORKING WITH ADVANCED SCAVENGING AND A TWO-STROKE ENGINE

CROSS REFERENCE TO RELATED APPLICATION

This application claims priority of European patent application no. 16 001 825.5, filed Aug. 19, 2016, the entire content of which is incorporated herein by reference.

FIELD OF THE INVENTION

The invention relates to a piston for a two-stroke engine operating with advanced scavenging, and to a two-stroke engine operating with advanced scavenging.

BACKGROUND OF THE INVENTION

US 2011/0197868 discloses a piston for a two-stroke engine operating with advanced scavenging, the piston having piston pockets which serve for connecting an air inlet, which opens at the cylinder bore, to transfer windows of transfer channels. Air from the air inlet is advanced in the transfer channels via the piston pocket. In the circumferential area located between the piston pockets, that edge of the piston which faces away from the piston base has a recess at which the piston has a reduced height.

SUMMARY OF THE INVENTION

It is an object of the invention to provide a piston for a two-stroke engine operating with advanced scavenging, which piston has a long service life. It is a further object of the invention to specify a two-stroke engine having a piston which has a long service life.

With regard to the piston, the object can, for example, be achieved by a piston for a two-stroke engine operating with advanced scavenging. The piston includes: a piston base having a top side; a piston skirt defining a first center axis; the first center axis forming a longitudinal center axis of the piston; the piston having two piston pin eyelets defining a second center axis; the second center axis defining a transverse axis; the piston defining a middle plane containing the longitudinal center axis of the piston; the middle plane being perpendicular to the transverse axis; the piston having at least one piston pocket arranged completely on a first side of the middle plane; the piston pocket and the top side of the piston base mutually defining a smallest distance (e) therebetween; the piston having a section plane perpendicular to the longitudinal center axis; the section plane and the top side of the piston base mutually defining a distance (m) therebetween; the distance (m) being greater than the smallest distance (e); the piston skirt having a location at which the middle plane intersects the piston skirt in the section plane; the piston skirt having a wall thickness (b) at the location; the piston defining a circumferential direction; a thickened region arranged between the section plane and the location in the circumferential direction; the thickened region having a wall thickness (a); and, the wall thickness (a) being at least 1.1 times the wall thickness (b) at the location.

The object can, for example, also be achieved by a piston for a two-stroke engine operating with advanced scavenging. The piston includes: a piston base having a top side; a piston skirt defining a first center axis; the first center axis forming a longitudinal center axis of the piston; the piston having two piston pin eyelets defining a second center axis; the second center axis defining a transverse axis; the piston defining a middle plane containing the longitudinal center axis of the piston; the middle plane being perpendicular to the transverse axis; the piston having two piston pockets arranged on opposite sides of the middle plane; the piston skirt having an edge facing away from the piston base; the piston defining a circumferential direction; the edge defining a recess between the two piston pockets; the piston skirt having a reduced height (I) at the recess; and, the edge having a chamfer at the recess at a radially outer side of the piston.

With regard to the two-stroke engine, the object can, for example, be achieved by a two-stroke engine including: a cylinder having a cylinder bore; a combustion chamber formed in the cylinder bore; a piston having a piston base and a piston skirt; the combustion chamber being delimited by the piston; a crankcase defining a crankcase interior; a crankshaft rotatably mounted in the crankcase; the piston being configured to drive the crankshaft; a transfer channel having a transfer window and being configured to connect the crankcase interior to the combustion chamber in at least one position of the piston; an air channel configured to supply scavenging air; the air channel opening at the cylinder bore via an air inlet; the piston including a piston base having a top side and a piston skirt defining a first center axis; the first center axis forming a longitudinal center axis of the piston; the piston having two piston pin eyelets defining a second center axis; the second center axis defining a transverse axis; the piston defining a middle plane containing the longitudinal center axis of the piston; the middle plane being perpendicular to the transverse axis; the piston having at least one piston pocket arranged entirely on a first side of the middle plane; the at least one piston pocket being configured to be at least partially overlapping with the air inlet and the transfer window in at least one position of the piston; the piston pocket and the top side of the piston base mutually defining a smallest distance (e) therebetween; the piston having a section plane perpendicular to the longitudinal center axis; the section plane and the top side of the piston base mutually defining a distance (m) therebetween; the distance (m) being greater than the smallest distance (e); the piston skirt having a location at which the middle plane intersects the piston skirt in the section plane; the piston skirt having a wall thickness (b) at the location; the piston defining a circumferential direction; a thickened region arranged between the section plane and the location in the circumferential direction; the thickened region having a wall thickness (a); and, the wall thickness (a) being at least 1.1 times the wall thickness (b) at the location.

The object can, for example, further be achieved by a two-stroke engine including: a piston having a piston base and a piston skirt; a cylinder having a cylinder bore; a combustion chamber formed in the cylinder bore and delimited by the piston; a crankcase; a crankshaft rotatably mounted in the crankcase; a connecting rod having a connecting rod eye; the piston being configured to drive the crankshaft via the connecting rod; the connecting rod being mounted on the crankshaft via the connecting rod eye; the piston base having a top side; the piston skirt defining a first center axis; the first center axis forming a longitudinal center axis of the piston; the piston having two piston pin eyelets defining a second center axis; the second center axis defining a transverse axis; the piston defining a transverse plane containing the transverse axis and the longitudinal center axis; the piston defining a middle plane containing the longitudinal center axis of the piston; the middle plane being perpendicular to the transverse axis; the piston having two piston pockets arranged on opposite sides of the middle plane; the piston skirt having an edge facing away from the piston base; the piston defining a circumferential direction; the edge defining a recess between the two piston pockets; the piston skirt having a reduced height (I) at the recess; the edge having a chamfer at the recess at a radially outer side of the piston; the transverse plane of the piston defining a first side and a second side lying opposite to the first side; the connecting rod eye being configured to be disposed on the first side during an upward stroke of the piston; and, the chamfer being arranged on the second side of the transverse plane during an upward stroke of the piston.

For a piston, it is provided that the piston has at least one section plane perpendicular to the longitudinal center axis of the piston, the distance of which section plane from the top side of the piston base is greater than the smallest distance of the piston pocket from the piston base. The piston skirt has a location at which a middle plane of the piston intersects the piston skirt in the section plane. In the circumferential direction between the piston pocket and this location, a thickened area is arranged in the section plane, the greatest wall thickness of which area is at least 1.1 times the wall thickness at the location. The thickened area is therefore arranged in the circumferential direction between the piston pocket and the section plane of the piston skirt with the middle plane. In the direction of the longitudinal center axis of the piston, the thickened area lies in a section plane which has a greater distance from the top side of the piston base than the smallest distance of the piston pocket from the piston base. Accordingly, the section plane in which the thickened area is arranged lies between a top edge of the piston pocket and the bottom side of the piston. The thickened area can also extend here between the piston pocket and the top side of the piston base.

It has been shown that increased loadings occur in the circumferential direction between the piston pocket and the location at which the middle plane intersects the piston skirt. The loadings can be better absorbed by the thickened area and conducted around the adjacent areas of the piston skirt, thus resulting in greater stability and, as a result, an increased service life of the piston. Owing to the fact that the thickened area is arranged between the location and the piston pocket and does not extend over the entire circumferential area between the piston pockets, a reduced weight of the piston can be achieved overall.

A section plane in which the thickened area is arranged advantageously contains the transverse axis of the piston. In particular, a section plane in which the thickened area is arranged runs on a bottom side of a piston pin receptacle, the bottom side being located away from the piston base. A section plane in which the thickened area is arranged particularly advantageously runs at an edge of the piston that faces away from the piston base. In particular, a section plane in which the thickened area is arranged runs on a bottom side of the piston, the bottom side facing away from the piston base. The thickened area advantageously extends over at least 50% of the height of the piston, as measured parallel to the longitudinal center axis. The thickened area preferably extends from the piston base as far as the edge of the piston.

The piston advantageously has two thickened areas. The piston preferably has two piston pockets on opposite sides of the middle plane, wherein a thickened area extends between each piston pocket and the location. The thickened areas are in particular arranged mirror-symmetrically with respect to the middle plane. The piston skirt advantageously has an edge facing away from the piston base. The edge facing away from the piston base is arranged on the bottom side of the piston. A recess at which the piston skirt has a reduced height is preferably provided in the circumferential area between the piston pockets. The thickened area advantageously at least partially overlaps the recess in the circumferential direction. It has been shown that, in particular in the area in which the height of the piston is reduced from the height provided in the area of the piston pocket to the reduced height at the recess, stresses may occur which lead to cracks in the area. This formation of cracks is prevented by the thickened area, and therefore just a comparatively small thickening of the piston skirt in the thickened area results in an increased service life of the piston.

In a particularly advantageous configuration, the edge on the recess of the radially outer side of the piston has a chamfer. During the upward stroke of the piston, the chamfer prevents oil which has accumulated at the cylinder bore from being scraped off by the piston, thus resulting in improved lubrication of the piston in the cylinder bore, and therefore the friction is reduced and the service life of the piston and of the two-stroke engine is thereby increased.

The recess at which the piston skirt has a reduced height advantageously merges with a transition region into that area of the piston skirt which is adjacent in the circumferential direction. In the transition region, the height of the piston is advantageously increased by at least 5%, in particular by at least 10%. In a particularly advantageous configuration, the thickened area extends as far as the edge of the piston. This makes it possible immediately at the transition region to prevent the formation of increased stresses and, as a result, the formation of cracks in the piston skirt. The thickened area advantageously covers the entire transition region in the circumferential direction. In a particularly advantageous configuration, the thickened area extends as far as the edge of the piston.

A simple configuration arises if the inner contour of the piston skirt has a rectilinear profile in the thickened area in the section plane. The rectilinear profile of the thickened area on the inner contour of the piston skirt achieves a particularly simple configuration and at the same time a sufficiently large thickening in the center of the thickened area. The piston skirt advantageously runs approximately cylindrically, and the inner contour of the piston skirt in the thickened area forms a secant at the approximately circular-arc-shaped profile of the contour of the piston skirt. On the outer side of the thickened area, the piston skirt advantageously runs in a curved manner, in particular approximately in the shape of a circular arc about the longitudinal center axis of the piston. It can be provided that the piston skirt has a cross section differing from the circular shape. The piston skirt can in particular have an elliptical, oval or cloverleaf-shaped configuration. A cloverleaf-shaped cross section here is a cross section in which the diameter is reduced in two directions lying obliquely with respect to each other. The deviation of the cross section from the circular shape is advantageously very small here.

The piston pocket advantageously has a delimiting edge facing the thickened area in the circumferential direction. The wall thickness of the piston skirt at the delimiting edge is preferably smaller here than the greatest wall thickness of the thickened area. Accordingly, the wall thickness of the piston skirt decreases in the circumferential direction between the thickened area and the piston pocket. The wall thickness at the delimiting edge is advantageously greater here than the wall thickness at the location at which the middle plane intersects the piston skirt. The wall thickness at the delimiting edge is preferably at least 1.1 times the wall thickness at the location at which the middle plane intersects the piston skirt.

In order to achieve an increased rigidity of the piston and at the same time good removal of heat from the piston base, it is provided that the piston advantageously has at least one rib which connects the piston base to the piston skirt. At least one rib preferably radially adjoins the thickened area within the thickened area. Additional stabilization of the piston skirt in the thickened area is achieved via the rib. The rib which radially adjoins the thickened area within the thickened area preferably does not extend over the entire height of the piston, but rather has a distance from the edge of the piston. The rib advantageously extends over at least 25% of the height of the piston. The rib preferably extends over at most 80% of the height of the piston. At least one rib is advantageously provided which adjoins the piston skirt radially within the location at which the middle plane of the piston intersects the piston skirt.

The piston advantageously has at least two ribs which have different heights. In a particularly advantageous configuration, a rib which adjoins the location at which the middle plane intersects the piston skirt is higher than the rib which adjoins the thickened area. A height of at least 25% of the height of the piston and at most 80% of the height of the piston is preferably provided for all of the ribs of the piston. The piston advantageously has a transverse plane which contains a longitudinal center axis of piston pin receptacles of the piston and the longitudinal center axis of the piston. Advantageously, at least one rib is arranged on that side of the transverse plane which lies opposite the thickened area. In a particularly advantageous configuration, ribs arranged mirror-symmetrically with respect to the transverse plane are provided on both sides of the transverse plane.

The piston is advantageously made of a light metal, in particular of magnesium.

For a two-stroke engine with a piston, it is provided that the two-stroke engine has a cylinder, in the cylinder bore of which a combustion chamber is formed which is delimited by the piston. The piston drives a crankshaft which is mounted rotatably in a crankcase. The two-stroke engine has at least one transfer channel which, in at least one position of the piston, connects a crankcase interior of the crankcase to the combustion chamber. The two-stroke engine has an air channel for supplying advanced scavenging air, which air channel opens with an air inlet at the cylinder bore. The piston pocket lies at least partially in congruence with the air inlet and with a transfer window of the transfer channel in at least one position of the piston. As a result, advanced scavenging air from the air inlet can be advanced in the at least one transfer channel via the piston pocket. The advanced scavenging air here is low-fuel or fuel-free combustion air.

It has been shown that, in the case of a piston for a two-stroke engine operating with advanced scavenging, the piston having a piston base and a piston skirt, wherein the center axis of the piston skirt forms a longitudinal center axis of the piston, wherein the piston has two piston pin eyelets, the center axis of which forms a transverse axis of the piston, wherein the piston has a middle plane which contains the longitudinal center axis of the piston and which runs perpendicularly to the transverse axis of the piston, wherein the piston has two piston pockets which are arranged on opposite sides of the middle plane, wherein the piston skirt has an edge facing away from the piston base, and wherein the edge in the circumferential area between the piston pockets has a recess at which the piston skirt has a reduced height, a greater service life of the piston is achieved if the edge at the recess on the radially outer side of the piston has a chamfer.

It has been shown that increased wear can occur at the recess at which the piston skirt has the reduced height. It has been shown that this wear can be caused by the fact that oil which has been deposited at the cylinder bore is scraped off by the edge of the piston in the area of the recess. This increases the friction between piston and cylinder bore in this area. In order to increase the service life of the piston and of a two-stroke engine operating with the piston, it is now provided that the edge at the recess on the radially outer side of the piston has a chamfer. The chamfer prevents the edge at the recess from being able to come into contact with the cylinder bore. The area of the edge of the piston is slightly set back from the cylinder bore because of the chamfer, and therefore the piston does not come into contact by means of its edge, but rather by means of the adjacent area of the piston skirt, with the cylinder bore. The chamfer has the effect that the piston floats on an oil film existing at the cylinder bore and does not scrape the oil film off the cylinder bore. In contrast to a rounded edge of the piston, that is, an edge running in a radius, the chamfer has the same inclination with respect to the cylinder bore in every area. Due to manufacturing tolerances, the width of the chamfer may differ from a desired width because of the external machining of the piston. On account of the uniform angle of inclination of the chamfer, the desired angle of inclination in this area is substantially ensured irrespective of manufacturing tolerances.

In the case of a two-stroke engine with a piston, it is provided that the two-stroke engine has a cylinder, in the cylinder bore of which a combustion chamber is formed which is delimited by the piston, wherein the piston drives a crankshaft, which is mounted rotatably in a crankcase, via a connecting rod, wherein the connecting rod is mounted on a connecting rod eye on the crankshaft, wherein the piston has a transverse plane which contains the longitudinal center axis and the transverse axis of the piston. It is advantageously provided that the chamfer is arranged on that side of the piston which, during the downward stroke of the piston, is arranged on the side of the transverse plane of the piston that lies opposite the connecting rod eye. As a result, the chamfer is arranged in the area of the edge of the piston that, because of the oblique position of the connecting rod, is in contact with the cylinder bore during the downward stroke of the piston.

The two-stroke engine advantageously has a mixture inlet, which is controlled by the piston, into the crankcase. The chamfer is advantageously arranged on that area of the edge which controls the mixture inlet. The control time of the mixture inlet, that is, the time at which the mixture inlet opens into the crankcase interior during the upward stroke of the piston, can be set via the position of the edge at the recess of the piston. In comparison to an optimum length of the piston skirt for guiding the piston, this may result in a shortened length of the piston skirt in the area. Nevertheless, scraping off of oil from the cylinder bore by the edge of the piston can be avoided in a simple manner via the chamfer. A two-stroke engine with sufficient filling of the crankcase with a fuel/air mixture and at the same time with a long service life can thereby be achieved.

In a particularly advantageous configuration, the recess is arranged on an inlet end of the piston, and the piston has an opposite outlet end. The inlet end and the outlet end are advantageously separated from each other by the transverse plane of the piston. The edge of the piston advantageously also has a chamfer on the outlet end. The chamfer on the inlet end advantageously extends over a circumferential angle about the longitudinal center axis of the piston of less than 180°, in particular of less than 150°. An angle of less than 120°, in particular of less than 90°, is preferably provided. The chamfer on the outlet end advantageously likewise extends over a circumferential angle of less than 180°, in particular less than 150°, preferably less than 120°. In a particularly preferred configuration, the chamfer on the outlet end extends over a circumferential angle of less than 100°. The circumferential angle over which the chamfer extends on the outlet end is particularly preferably greater than the circumferential angle over which the chamfer extends on the inlet end.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
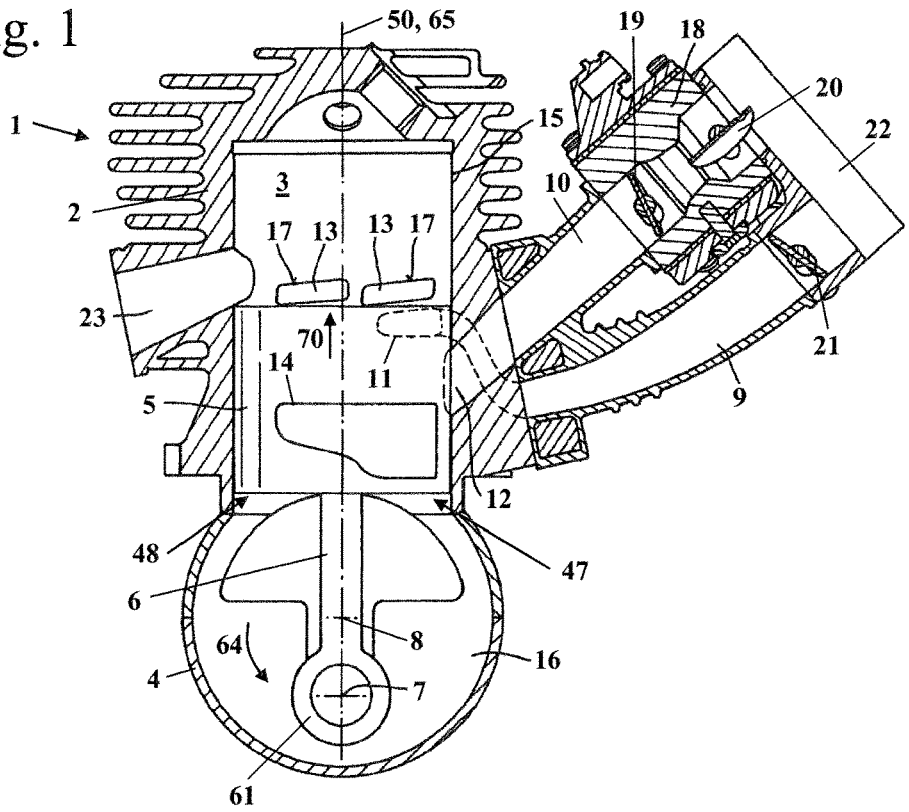
FIG. 1 shows a schematic sectional illustration of a two-stroke engine.

FIG. 1 schematically shows an embodiment of a two-stroke engine 1. The two-stroke engine 1 is configured as a single cylinder engine and has a cylinder 2 in which a combustion chamber 3 is formed. The combustion chamber 3 is delimited by a piston 5 which is mounted so as to move to and fro in a cylinder bore 15 of the cylinder 2. FIG. 1 shows the piston 5 at the bottom dead center. The piston 5 drives a crankshaft 7 via a connecting rod 6. The crankshaft 7 is mounted in a crankcase interior 16 of a crankcase 4 so as to be rotatable about a rotational axis 8. The two-stroke engine 1 can be, for example, the drive motor in a handheld work apparatus, such as a power saw, an angle grinder, a blower device or the like. The crankshaft 7 advantageously serves for driving a tool of the work apparatus. The piston 5 advantageously has two piston pockets 14, one of which is shown in FIG. 1. The piston pockets 14 are arranged on the piston 5 symmetrically with respect to the section plane shown in FIG. 1.

The two-stroke engine 1 has an air channel 9 which is connected to an air filter 22. Fuel-free or low-fuel advanced scavenging air is sucked up by the air filter 22 via the air channel 9. An air flap 21 for controlling the quantity of advanced scavenging air supplied via the air channel 9 is arranged in the air channel 9. The air channel 9 opens with an air inlet 11 at the cylinder bore 15. A mixture channel 10 is provided for supplying a fuel/air mixture. The mixture channel 10 is connected to the air filter 22 via a carburetor 18. In the embodiment, a throttle flap 19 and a choke flap 20 are mounted pivotably in the carburetor 18. The throttle flap 19 and the choke flap 20 serve to set the quantity of combustion air and fuel that is fed in via the mixture channel 10. Instead of by means of a conventional carburetor 18, the fuel can also be supplied in a different way, for example via an injection valve or a carburetor with a solenoid valve. The mixture channel 10 opens with a mixture inlet 12 at the cylinder bore 15. The air inlet 11 and the mixture inlet 12 are controlled by the piston 5.

The two-stroke engine 1 has transfer channels 13 which open with transfer windows 17 into the combustion chamber 3. The transfer windows 17 are also controlled by the piston 5. In the area of the bottom dead center of the piston 5, the transfer channels 13 (not illustrated specifically in FIG. 1) connect the crankcase interior 16 to the combustion chamber 3. During operation, a fuel/air mixture is sucked up through the mixture inlet 12 into the crankcase interior 16 during the upward stroke of the piston 5. The upward stroke of the piston here denotes the movement of the piston 5 out of the position (shown in FIG. 1) of the piston 5 in the bottom dead center in the direction of the combustion chamber 3, that is, in the direction of the arrow 70 in FIG. 1. In the area of the top dead center of the piston 5, the piston pockets 14 each connect an air inlet 11 to transfer windows 17. As a result, advanced scavenging air is drawn out of the air channel 9 into the transfer channels 13. During the upward stroke of the piston 5, mixture which is already present in the combustion chamber 3 is compressed at the same time and is ignited in the area of the top dead center of the piston 5 by a spark plug (not illustrated).

The combustion pressure accelerates the piston 5 back in the direction of the crankcase 4. An outlet 23 which is controlled by the piston 5 leads out of the combustion chamber 3. As soon as the outlet 23 is opened by the piston 5, the exhaust gases flow out of the combustion chamber 3 through the outlet 23. After a further downward stroke, the piston 5 opens the transfer windows 17 to the combustion chamber 3. The advanced scavenging air which is advanced in the transfer channels 13 flows into the combustion chamber 3 and flushes exhaust gases out of the combustion chamber 3 through the outlet 23. A fresh fuel/air mixture which has been pre-compressed in the crankcase interior 16 flows in from the crankcase interior 16. During the following engine cycle, the mixture in the combustion chamber 3 is compressed during the upward stroke of the piston 5, while fresh mixture is at the same time sucked up into the crankcase interior 16 and advanced scavenging air is drawn into the transfer channels 13.

Figure 2:
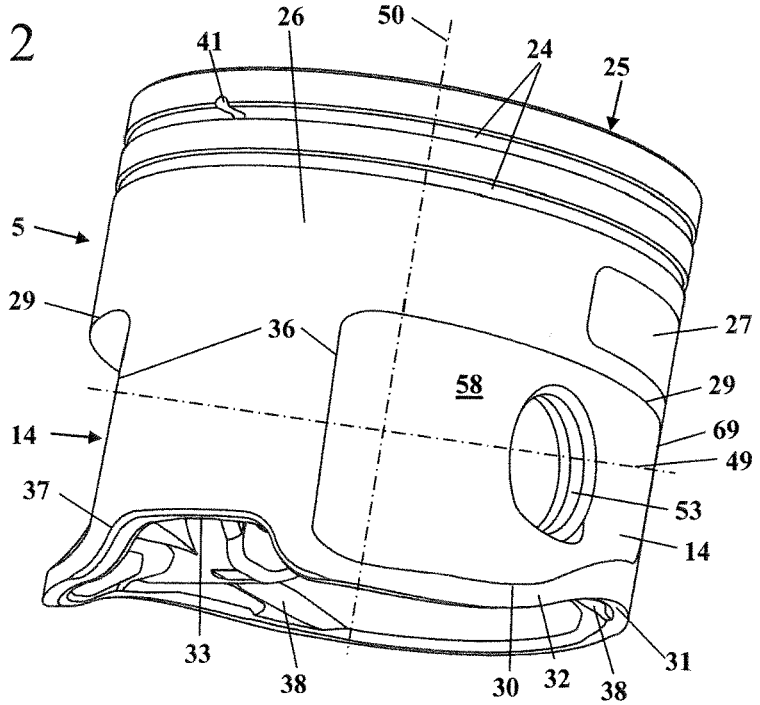
FIG. 2 shows a perspective illustration of the piston of the two-stroke engine from FIG. 1.

As FIG. 2 shows, the piston pockets 14 have an upper control edge 29 which is advantageously arranged in the area of the top dead center of the piston 5 in such a manner that the transfer windows 17 are arranged completely in congruence with the piston pocket 14. The upper control edge 29 is that control edge of the piston pocket 14 which lies closest to the combustion chamber 3. The piston pocket 14 also has a lower control edge 30 which lies facing the crankcase 4. The lower control edge 30 is that control edge of the piston pocket 14 which lies furthest away from the combustion chamber 3, and delimits the piston pocket 14 in the direction of the crankcase 4. At the top dead center of the piston 5, the lower control edge 30 is advantageously arranged in such a way that the air inlet 11 lies completely in congruence with the piston pocket 14. The piston 5 has an edge 31 on its side facing the crankcase 4. The edge 31 is that delimitation of the piston 5 which faces the crankcase 4. A web 32 which is formed by a section of a piston 26 is formed in each case between the piston pockets 14 and the edge 31. The edge 31 forms a bottom side of the piston 5.

The piston 5 has a piston base 25 which delimits the combustion chamber 3 and which, in the embodiment, runs approximately perpendicularly to a longitudinal center axis 50 of the piston 5. In addition, the piston 5 has a piston skirt 26 which adjoins the piston base and which advantageously follows the profile of the cylinder bore 15. The outer side of the piston skirt 26 advantageously runs approximately cylindrically. The outer side of the piston skirt 26 here can have a cross section which is exactly cylindrical or which deviates slightly from the cylindrical form, for example is slightly oval or elliptical. The longitudinal center axis 50 of the piston 5 is the center axis of the piston skirt 26.

As FIG. 2 shows, two piston ring grooves 24 which serve for receiving piston rings (not shown) are provided on the piston skirt 26 adjacent to the piston base 25. A bore 41 which serves for receiving a securing pin for a piston ring is shown in one of the piston ring grooves 24. A corresponding bore is also provided for the further piston ring groove 24 on that side of the piston 5 which is not shown in FIG. 2. As FIG. 2 also shows, a deepening 27 is provided on the piston skirt 26 between each piston pocket 14 and the lower piston ring groove 24. The deepening 27 serves for reducing the weight of the piston 5. The deepening 27 is configured here in such a manner that, during a piston stroke, it lies in congruence with just one or with both transfer windows 17, but not with the air inlet 11. As a result, a connection cannot be produced between the air inlet 11 and the transfer windows 17 via the deepening 27.

The connecting rod 6 (FIG. 1) is connected to the piston 5 via a piston pin (not shown) which is held in piston pin receptacles 53 of the piston 5. As FIG. 2 shows, the piston pin receptacles 53 lie completely within the piston pockets 14 in the embodiment. The piston pin receptacles 53 are advantageously located in the space between the control edges 29 and 30 of the piston pockets 14. The piston pocket 14 is in each case delimited by a rear wall 58 toward the crankcase interior 16. As FIG. 2 also shows, connecting ribs 38 which connect the rear wall 58 of the piston pockets 14 to the piston skirt 26 are provided in the interior of the piston skirt 26. The piston 5 has inlet-near delimiting edges 36 on the piston pockets 14, on those sides of the piston pockets 14 which face the recess 33 in the circumferential direction. The inlet-near delimiting edges 36 run approximately parallel to the longitudinal center axis 50. In addition, the piston pockets 14 have outlet-near delimiting edges 69. The outlet-near delimiting edges 69 also run approximately parallel to the longitudinal center axis 50. Each piston pocket 14 is delimited by the control edges 29 and 30 in the direction of the longitudinal center axis 50 and by the delimiting edges 36 and 69 in the circumferential direction.

On the side facing the mixture inlet 12, the piston skirt 26 has a recess 33 on the side which faces the crankcase 4 and lies away from the combustion chamber 3. The height of the piston skirt 26 is reduced at the recess 33. The recess 33 is formed as a bulge of the edge 31 in the direction of the piston base 25. The position of the edge 31 at the recess 33 defines the control time at which the mixture inlet 12 (FIG. 1) is opened and closed. At the edge 31, a chamfer 37 is provided in the area of the recess 33 at the transition of the edge 31 to the outer side of the piston skirt 26.

Figure 3:
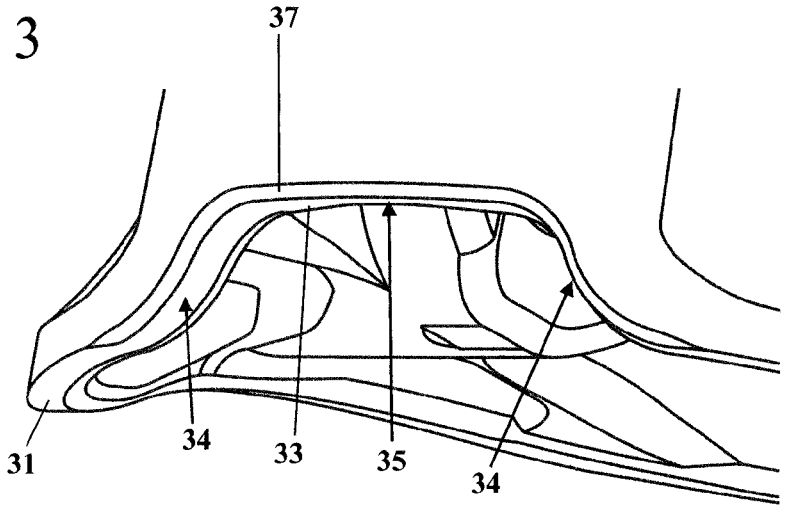
FIG. 3 shows an enlarged cutout of an area of the edge of the piston from FIG. 2.
Figure 4:
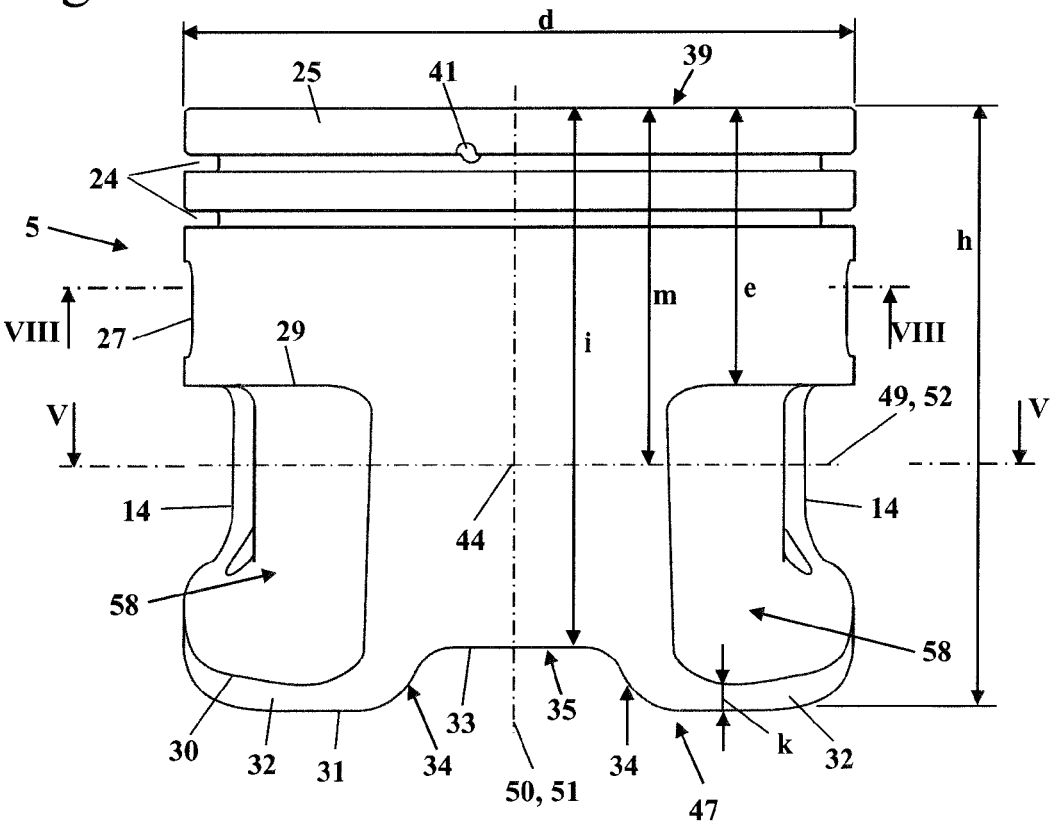
FIG. 4 shows a side view of the piston from FIG. 2.

FIG. 3 shows the configuration of the chamfer 37 in detail. The recess 33 has a roof 35 on which the edge 31 runs approximately parallel to the piston base 25 (FIG. 2). This is also shown in FIG. 4. A transition region 34 is in each case adjacent to the roof 35 of the recess 33 on both sides in the circumferential direction. At the transition region 34, the edge 31 runs at an inclination with respect to the longitudinal center axis 50 of the piston 5. The inclined profile of the transition regions 34 is also shown in FIG. 4. The transition regions 34 connect the roof 35 to those areas of the edge 31 which lie outside the recess 33.

As FIG. 4 shows, the piston 5 has a diameter d. The diameter d is advantageously the largest diameter of the piston 5 and, in the embodiment, is measured on a top side 39 of the piston base 25. The top side 39 of the piston base 25 here is that side of the piston base 25 which delimits the combustion chamber 3 in an engine, for example in the two-stroke engine 1. The top side 39 is that side of the piston base 25 which faces away from the piston pin receptacles 53 (FIG. 2). The piston 5 has a height h which is measured parallel to the longitudinal center axis 50 of the piston 5. The height h is the greatest height of the piston 5. The diameter d of the piston 5 is advantageously 70% to 140%, in particular 80% to 130%, preferably 90% to 120% of the height h. The diameter d is particularly preferably greater than the height h.

The piston pin receptacles 53 (FIG. 2) have a center axis which forms a transverse axis 49 of the piston 5. The transverse axis 49 is also shown in FIG. 2. In the side view shown in FIG. 4, the transverse axis 49 runs perpendicularly to the longitudinal center axis 50. The piston 5 has a middle plane 51 which contains the longitudinal center axis 50 of the piston 5 and runs perpendicularly to the transverse axis 49. In the side view shown in FIG. 4, the longitudinal center axis 50 and the middle plane 51 coincide. The piston 5 has a section plane 52 running perpendicularly to the longitudinal center axis 50. A section plane 52 which coincides with the transverse axis 49 is shown by way of example in the side view shown in FIG. 4. The section plane 52 has a distance m from the top side 39 of the piston base 25. The upper control edge 29 of the piston pocket 14 has a smallest distance e from the top side 39. In the embodiment, the control edge 29 runs in a plane which runs perpendicularly to the longitudinal center axis 50. If the upper control edge 29 does not run at a uniform distance from the top side 39, the distance e is measured at that location of the control edge 29 which has the smallest distance from the top side 39. The distance m of the section plane 52 is advantageously greater than the smallest distance e of the control edge 29 from the top side 39. Accordingly, the section plane 52 lies in an engine on that side of the upper control edge 29 which faces the crankcase 4 (FIG. 1). In the embodiment, the section plane 52 intersects the two piston pockets 14.

The piston 5 has a reduced height i at the recess 33. The reduced height i is the distance, if measured parallel to the longitudinal center axis 50, of the edge 31 on the roof 35 of the recess 33 from the top side 39 of the piston 5. The reduced height i at the recess 33 is advantageously 70% to 98%, in particular 80% to 95% of the height h of the piston 5. In the embodiment, the height i is greater than the distance m of the section plane 52 from the top side 39. However, it can also be provided that the distance m is greater than the reduced height I, that is, the section plane 52 runs through the recess 33. In the transition region 34, the height of the piston 5 is increased by at least 5%, in particular at least 10%. Accordingly, the height h of the piston 5 is at least 105%, in particular at least 110% of the reduced height i at the recess 33.

The piston 5 has an inlet end 47 on which the recess 33 is arranged. As FIG. 1 shows, the piston 5 also has an outlet end 48 which controls the outlet 23. The inlet end 47 and the outlet end 48 are separated by a transverse plane 65 (shown in FIG. 1) of the piston 5, the transverse plane containing the longitudinal center axis 50 and the transverse axis 49 (FIG. 2). As FIG. 1 shows, during operation the crankshaft 8 rotates in a rotational direction 64. The crankshaft 7 is connected to the connecting rod 6 at a connecting rod eye 61. The rotational direction 64 is directed in such a manner that, during the downward stroke of the piston 5, the connecting rod eye 61 is arranged on the outlet end of the transverse plane 65, the outlet end facing the outlet 23, and during the upward stroke of the piston 5, is arranged on the inlet end of the transverse plane 65, the inlet end facing the mixture inlet 12 and the air inlet 11. The outlet end of the transverse plane 65 here is that side of the transverse plane 65 on which the outlet end 48 of the piston 5 is located, and the inlet end of the transverse plane 65 is that side of the transverse plane 65 on which the inlet end 47 of the piston 5 is located. During the downward stroke of the piston 5, the connecting rod eye 61 and the recess 33 (FIG. 2) are located on opposite sides of the transverse plane 65. The formation of the chamfer 37 on the inlet end 47 of the piston 5 prevents the edge 31 of the piston 5 from scraping off oil, which has accumulated in the cylinder bore 15, in the region of the recess 33.

As FIG. 4 shows, the web 32 has a height k. The height k can be approximately 1 mm to approximately 5 mm, in particular approximately 1 mm to approximately 3 mm. The height of the web 32 does not have to be constant here, but rather can change along the circumference of the piston 5. The web 32 serves for sealing between the volume enclosed by the piston pocket 26 and cylinder bore 15 and the crankcase interior 16.

Figure 5:
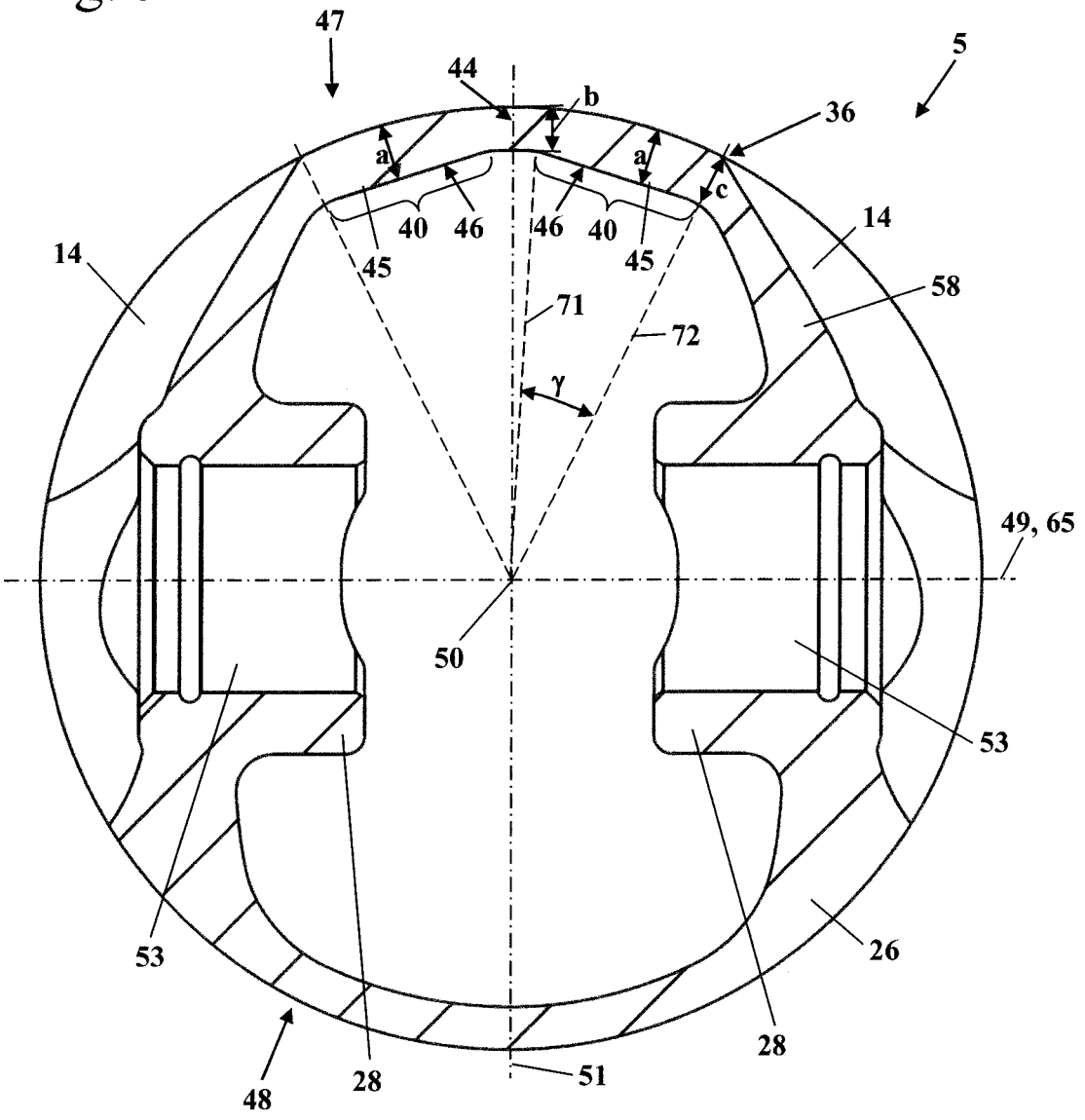
FIG. 5 shows a section along the line V-V from FIG. 4.

As FIG. 5 shows, the piston pin receptacles 53 are formed on piston pin eyelets 28 which project into the space surrounded by the piston skirt 26. FIG. 5 shows a section along the section plane 52. As FIG. 5 shows, the middle plane 51 intersects the piston skirt 26 on the inlet end 47 at a location 44. The location 44 has the form of a line oriented radially with respect to the longitudinal center axis 50 of the piston 5 since it constitutes the section of the section plane 52 with the middle plane 51. The location 44 is also shown in FIG. 4. At the location 44, the piston skirt 26 has a wall thickness b. As FIG. 5 also shows, a thickened area 40 is arranged in each case on both sides of the location 44 between the location 44 and the delimiting edge 36 of the piston pockets 14 in the circumferential direction. In the thickened area 40, the piston skirt 26 has a greatest wall thickness a which is at least 1.1 times the wall thickness b at the location 44. The wall thickness a is preferably at least 1.15 times, in particular at least 1.2 times the wall thickness b. The wall thickness a in the thickened area 40 is not constant over the entire thickened area 40 but rather initially increases, as viewed in the circumferential direction, from the area arranged adjacent to the location 44, and then decreases again.

As FIG. 5 also shows, the thickened area 40 extends over a circumferential angle $\gamma$ about the longitudinal center axis 50, the circumferential angle advantageously being of 5° to 45°, in particular of 10° to 35°, preferably of 15° to 25°. The circumferential angle $\gamma$ is measured here between a first reference line 71 and a second reference line 72. In the section plane 52, the first reference line 71 connects the longitudinal center axis 50 to that location of the piston skirt 26 at which the wall thickness of the piston skirt 26 increases in relation to the wall thickness b at the location 44. In the section plane 52, the second reference line 72 connects the longitudinal center axis 50 to the inlet-near delimiting edge 36 of the piston pocket 14. At the inlet-near delimiting edge 36, the piston skirt 26 has, in the section plane 52, a wall thickness c which is lower than the greatest wall thickness a of the thickened area 40. The wall thickness c at the delimiting edge 36 is greater than the wall thickness b at the location 44. The wall thickness c at the delimiting edge 36 is advantageously 1.05 times, in particular at least 1.1 times the wall thickness b at the location 44.

As FIG. 5 shows, the piston pockets 14 are arranged and formed mirror-symmetrically to each other with respect to the middle plane 51. As FIG. 5 also shows, the thickened areas 40 are arranged and formed mirror-symmetrically to each other with respect to the middle plane 51. The piston pockets 14 and the thickened areas 40 are advantageously arranged and formed mirror-symmetrically to one another with respect to the middle plane 51. At the thickened areas 40, the piston skirt 26 has an inner contour 46 which runs rectilinearly. However, it can also be provided that the inner contour 46 runs in a curved manner. The thickened area 40 is in each case formed by a thickening 45 on the inner side of the piston skirt 26.

Figure 6:
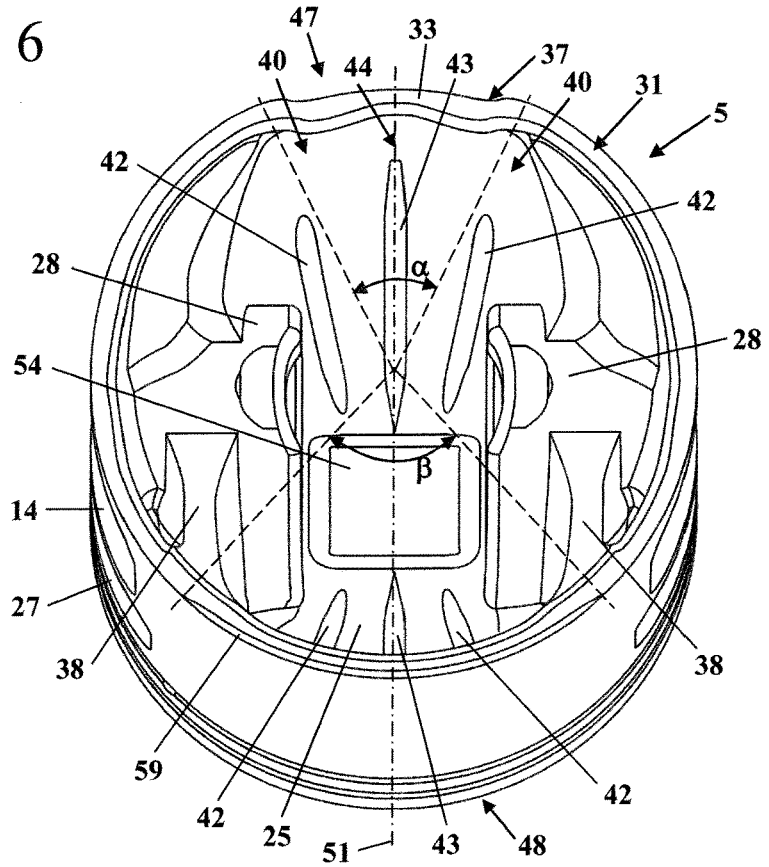
FIG. 6 shows a perspective view of the piston from the side facing the crankcase.

The thickened areas 40 advantageously extend over at least 50% of the height h of the piston 5 (FIG. 2). As FIG. 6 shows, the thickened areas 40 in the embodiment extend as far as the edge 31, wherein the inner contour of the piston 5 merges with a chamfer or a rounding into the edge 31. In the embodiment, the thickened areas 40 connect the piston base 25 to the edge 31 of the piston 5. The inner contour 46 of the thickened areas 40 can run parallel to the longitudinal center axis 50 or can be configured to be slightly inclined with respect to the longitudinal center axis 50, thus resulting in a slight pull-out bevel. The pull-out bevel permits the piston 5 to be demolded during production in a casting process. The pull-out bevel is advantageously 0.5° to 3°.

A section plane 52 (FIG. 4) which contains the transverse axis 49 is shown in the embodiment. The thickened area 40 is advantageously provided in a corresponding manner in a section plane which runs perpendicularly to the longitudinal center axis 50 at the control edge 29 and/or in a section plane which runs perpendicularly to the longitudinal center axis 50 at a lower edge 66 (shown in FIG. 7) of the piston pin receptacles 53. The lower edge 66 of the piston pin receptacles 53 is in this case that edge of the piston pin receptacles 53 which lies away from the top side 39 (FIG. 4) of the piston base 25. The thickened area 40 preferably runs at least from a section plane containing the control edge 29 and running perpendicularly to the longitudinal center axis 50 as far as the edge 31 at the recess 33.

As FIG. 6 shows, ribs 42 and 43 are provided on the inner side of the piston skirt 26. The ribs 42 and 43 connect the piston skirt 26 to the piston base 25. In the embodiment, a rib 43 is arranged on the inlet end 47 and a rib 43 is arranged on the outlet end 48. The ribs 43 advantageously run mirror-symmetrically to each other with respect to the transverse plane 65 (FIG. 5). The ribs 43 are intersected by the middle plane 51 and are formed mirror-symmetrically to the middle plane 51. On both sides of the ribs 43, ribs 42 are provided in each case on the inlet end 47 and on the outlet end 48. The ribs 42 and 43 are in each case formed individually and are connected to each other exclusively via the piston skirt 26 and the piston base 25, but not directly. As FIG. 5 shows, the ribs 42 and 43 end above the section plane 52 and do not project into the section plane 52.

Figure 7:
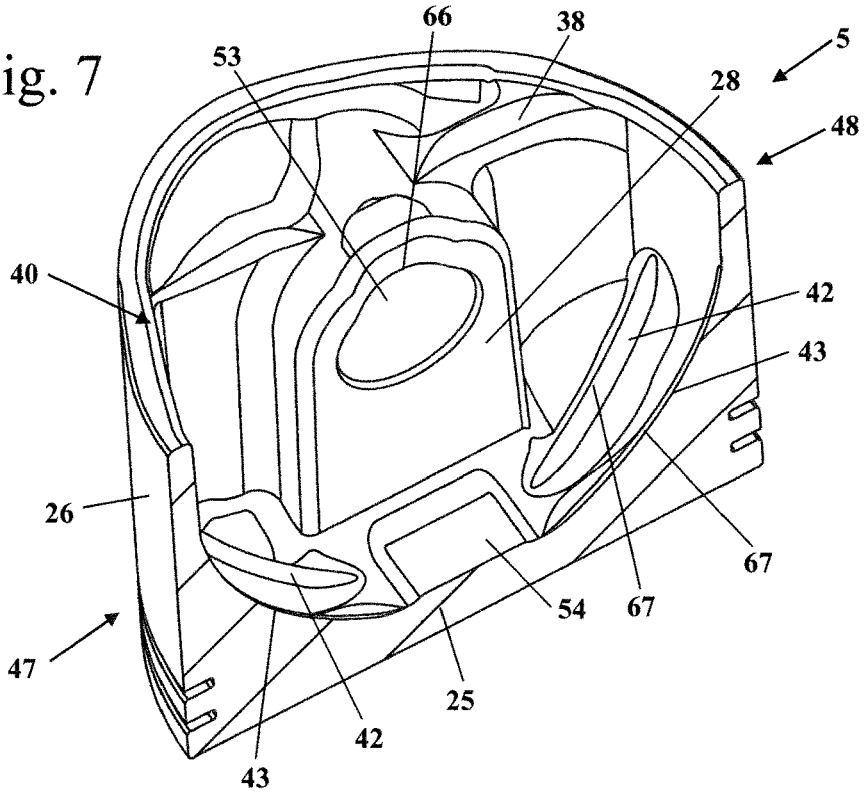
FIG. 7 shows a perspective sectional illustration of the piston through the middle plane.

As FIG. 6 shows, the chamfer 37 on the inlet end 47 extends over a circumferential angle $\alpha$ along the longitudinal center axis 50, the circumferential angle being less than 180°, in particular less than 150°, preferably less than 120°, in particular less than 90°. In the embodiment, an angle $\alpha$ of less than 60° is provided. As FIG. 7 shows, a chamfer 59 at the edge 31 of the piston skirt 26 is also arranged on the outlet end 48. As shown schematically in FIG. 6, the chamfer 59 extends over a circumferential angle β which is likewise less than 180°, in particular less than 150°, preferably less than 120°, advantageously less than 100°. The circumferential angle β is advantageously greater than the circumferential angle α. In the embodiment, a circumferential angle β of approximately 80° to 100° is provided. The angles α and β are advantageously selected in such a manner that the chamfers 37 and 59 predominantly run in the area arranged in the circumferential direction between the piston pockets 14. During operation in a two-stroke engine 1 (FIG. 1), the piston 5 is placed against the inlet end 47 or against the outlet end 48 at the cylinder bore 15 because of the forces exerted via the connecting rod 6. In the process, the piston 5 tilts slightly about the transverse axis 49. The chamfers 37 and 59 advantageously extend in the circumferential regions of the piston 5, which circumferential regions are placed against the cylinder bore 15 of the two-stroke engine 1 during operation.

As FIGS. 6 and 7 show, connecting ribs 38 run in each case between a piston pin eyelet 28 and the piston skirt 26. The connecting ribs 38 extend approximately parallel to the middle plane 51.

As FIG. 7 shows, the ribs 42 and 43 each have at least one front end 67 projecting into the interior of the piston 5. The front ends 67 advantageously run along the ribs 42 and 43 in a curved manner, namely curved concavely. A stop surface 54 formed on the piston base 26 is also shown in FIG. 6 and FIG. 7. During the production of the piston 5, the stop surface 54 serves as a stop for fixing the piston 5 during the external machining of the piston skirt 26.

Figure 8:
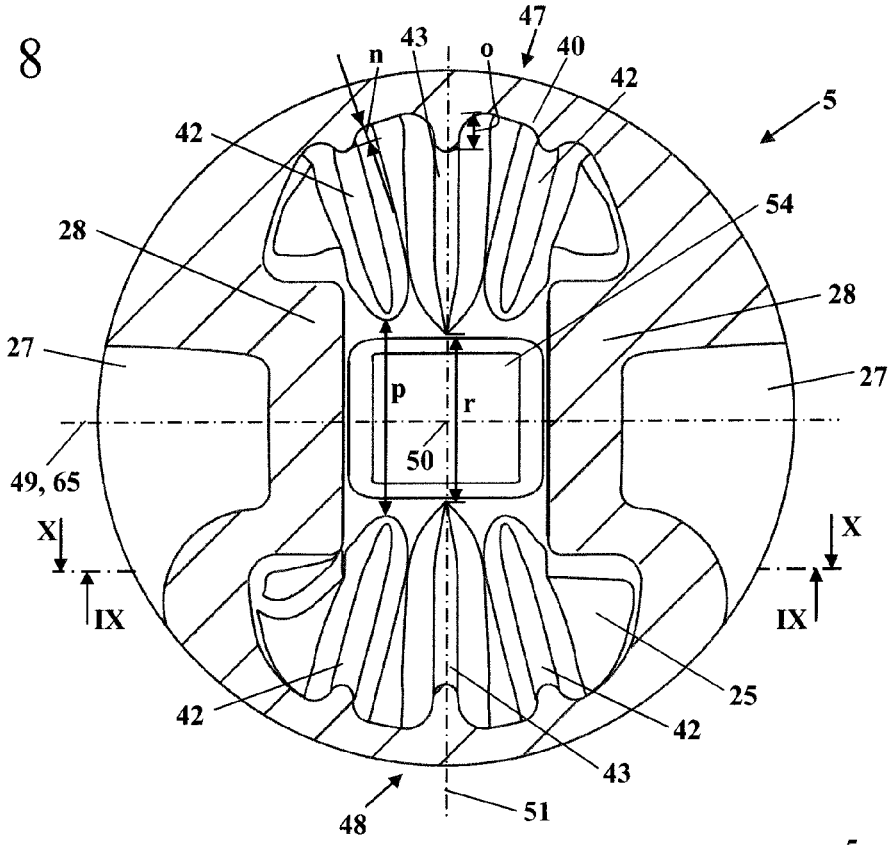
FIG. 8 shows a section along the line VIII-VIII in FIG. 4.

FIG. 8 shows a section through the deepenings 27. The deepenings 27 extend, as FIG. 8 shows, into the piston pin eyelets 28, and therefore no accumulation of material is formed in the piston pin eyelets 28 between the piston pin receptacle 53 and the piston base 25 (FIG. 7). The deepenings 27 serve to reduce the weight of the piston 5.

FIG. 8 shows the configuration of the ribs 42 and 43 in detail. As FIG. 8 shows, mutually opposite ribs 42 and 43 which are formed mirror-symmetrically with respect to the transverse plane 65 are each at a distance from one another. The stop surface 54 lies between the ribs 42 and 43 on the inlet end 47 and the ribs 42 and the rib 43 on the outlet end 48 (FIG. 7). Opposite ribs 42 have a distance p from each other. The distance p is advantageously more than 10% of the diameter d of the piston 5 (FIG. 4). The mutually opposite ribs 43 have a distance r from each other, the distance advantageously being smaller than the distance p. In the section plane shown in FIG. 8, the ribs 42 on the piston skirt 26 have a thickness n. The thickness n is the thickness of the ribs 42. The ribs 43 have a thickness o which is greater than the thickness n. The thickness o is the thickness of the ribs 43. The thickness o is advantageously 1.1 times to 1.8 times the thickness n. As FIG. 8 also shows, the ribs 42 and 43 lie at a small distance from each other and at a distance from the piston pin eyelets 28. As FIG. 8 shows, the connecting ribs 42 are arranged on the thickened areas 40 and additionally reinforce the piston skirt 26 at the thickened areas 40.

Figure 9:
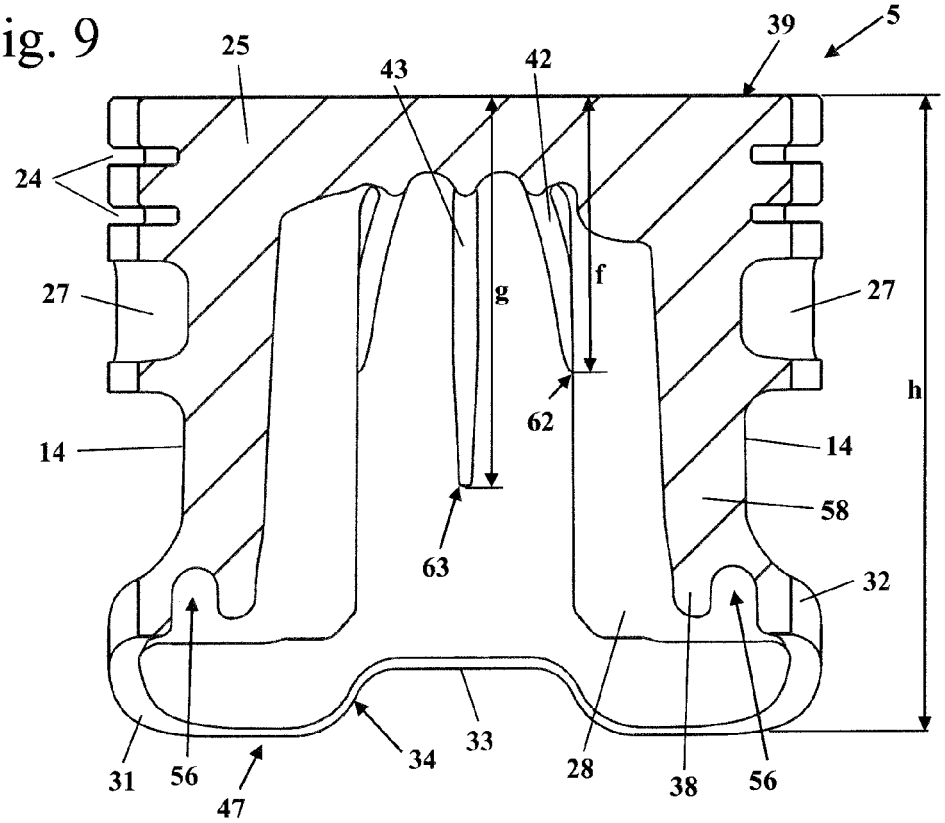
FIG. 9 shows a section along the line IX-IX in FIG. 8.

The ribs 42 and 43 which are arranged on the inlet end 47 are shown in FIG. 9. As FIG. 9 shows, the ribs 42 each have a tip 62 which is arranged on those sides of the ribs 42 which face away from the top side 39. The tip 62 has a distance f from the top side 39. The distance f is advantageously 30% to 70% of the height h of the piston 5. The rib 43 has a tip 63 which lies facing away from the top side 39 and which has a distance g from the top side 39. The distance g is significantly greater than the distance f and is advantageously 1.1 times to 1.5 times the distance f. The distance g is advantageously 50% to 80% of the height h of the piston 5.

FIG. 9 also shows the connecting rib 38. A deepening 56 is formed between the connecting rib 38 and the piston skirt 26. The connecting rib 38 runs in an extension of the rear wall 58 on the piston pocket 14. The deepening 56 is delimited by the connecting rib 38 and the web 32 and also by the rear wall 58 of the piston pocket 14 and the piston pin eyelet 28.

Figure 10:
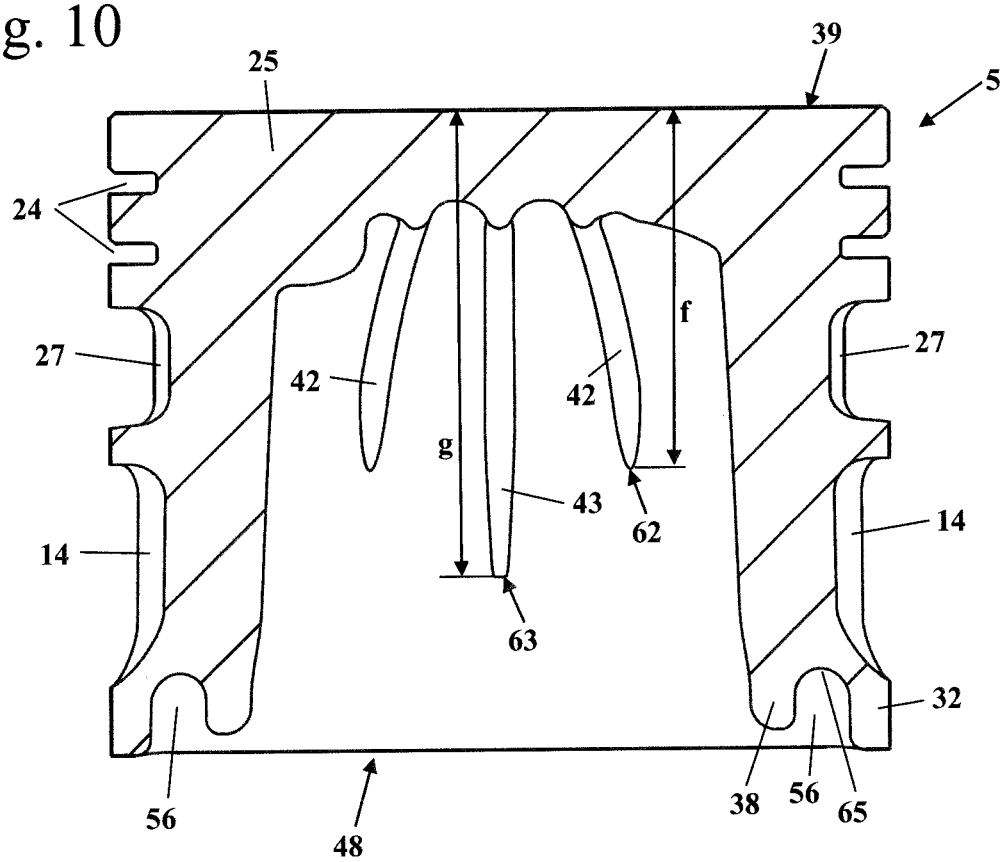
FIG. 10 shows a section along the line X-X in FIG. 8.

FIG. 10 shows the outlet end 48 of the piston 5. Ribs 42 and 43 are arranged on the outlet end 48, the ribs being formed mirror-symmetrically with respect to the transverse plane 65 to the ribs 42 and 43 on the inlet end 47. The rib 43 has a tip 63 which lies at a distance g from the top side 39 of the piston 5. The ribs 42 arranged on both sides with respect to the rib 43 each have a tip 62 which is arranged at a distance f from the top side 39 of the piston 5.

It is understood that the foregoing description is that of the preferred embodiments of the invention and that various changes and modifications may be made thereto without departing from the spirit and scope of the invention as defined in the appended claims.

What is claimed is:

1. A piston for a two-stroke engine operating with advanced scavenging, the piston comprising:

a piston base having a top side;

a piston skirt defining a first center axis;

said first center axis forming a longitudinal center axis of the piston;

the piston having two piston pin eyelets defining a second center axis;

said second center axis defining a transverse axis;

the piston defining a middle plane containing said longitudinal center axis of the piston;

said middle plane being perpendicular to said transverse axis;

the piston having at least one piston pocket arranged completely on a first side of said middle plane;

said piston pocket and said top side of said piston base mutually defining a smallest distance (e) therebetween;

the piston having a section plane perpendicular to said longitudinal center axis;

said section plane and said top side of said piston base mutually defining a distance (m) therebetween;

said distance (m) being greater than said smallest distance (e);

said piston skirt having a location at which said middle plane intersects said piston skirt in said section plane;

said piston skirt having a wall thickness (b) at said location;

the piston defining a circumferential direction;

a thickened region arranged in said section plane between said pocket and said location in said circumferential direction;

said thickened region having a wall thickness (a); and, said wall thickness (a) being at least 1.1 times said wall thickness (b) at said location.

2. The piston of claim 1, wherein:

said at least one piston pocket includes a first piston pocket and a second piston pocket;

said thickened region is a first thickened region;

said first piston pocket and said second piston pocket are arranged on opposite sides of said middle plane;

said first thickened region extends from said first piston pocket to said location; and, the piston has a second thickened region extending from said second piston pocket to said location.

3. The piston of claim 2, wherein said piston skirt has an edge facing away from said piston base.

4. The piston of claim 3, wherein:

said edge defines a recess between said first piston pocket and said second piston pocket;

said piston skirt having a reduced height (i) at said recess; and, said first thickened region and said second thickened region conjointly at least partially overlap said recess.

5. The piston of claim 4, wherein said edge has a chamfer at said recess at a radially outwardly lying side of the piston.

6. The piston of claim 4, wherein:

said recess has a transition region in which said recess transitions into an adjacent region of said piston skirt;

said adjacent region is adjacent to said recess in said circumferential direction; and, the piston has a height which increases by at least 5% in said transition region.

7. The piston of claim 3, wherein each of said first thickened region and said second thickened region extends up to said edge.

8. The piston of claim 1, wherein said piston skirt has an inner contour which runs straight in said thickened region in said section plane.

9. The piston of claim 1, wherein said thickened region extends over at least 50% of a height of the piston measured parallel to said longitudinal center axis.

10. The piston of claim 1 further comprising:

at least one rib connecting said piston skirt and said piston base; and, at least one of said at least one ribs adjoins said thickened region radially within said thickened region.

11. The piston of claim 1, wherein the piston is made of a light metal.

12. The piston of claim 1, wherein the piston is made of magnesium.

13. A two-stroke engine comprising:

a cylinder having a cylinder bore;

a combustion chamber formed in said cylinder bore;

a piston having a piston base and a piston skirt;

said combustion chamber being delimited by said piston;

a crankcase defining a crankcase interior;

a crankshaft rotatably mounted in said crankcase;

said piston being configured to drive said crankshaft;

a transfer channel having a transfer window and being configured to connect said crankcase interior to said combustion chamber in at least one position of said piston;

an air channel configured to supply scavenging air;

said air channel opening at said cylinder bore via an air inlet;

said piston including a piston base having a top side and a piston skirt defining a first center axis;

said first center axis forming a longitudinal center axis of said piston;

said piston having two piston pin eyelets defining a second center axis;

said second center axis defining a transverse axis;

said piston defining a middle plane containing said longitudinal center axis of said piston;

said middle plane being perpendicular to said transverse axis;

said piston having at least one piston pocket arranged entirely on a first side of said middle plane;

said at least one piston pocket being configured to be at least partially overlapping with said air inlet and said transfer window in at least one position of said piston;

said piston pocket and said top side of said piston base mutually defining a smallest distance (e) therebetween;

said piston having a section plane perpendicular to said longitudinal center axis;

said section plane and said top side of said piston base mutually defining a distance (m) therebetween;

said distance (m) being greater than said smallest distance (e);

said piston skirt having a location at which said middle plane intersects said piston skirt in said section plane;

said piston skirt having a wall thickness (b) at said location;

said piston defining a circumferential direction;

a thickened region arranged in said section plane between said pocket and said location in said circumferential direction;

said thickened region having a wall thickness (a); and, said wall thickness (a) being at least 1.1 times said wall thickness (b) at said location.

14. A piston for a two-stroke engine operating with advanced scavenging, the piston comprising:

a piston base having a top side;

a piston skirt defining a first center axis;

said first center axis forming a longitudinal center axis of the piston;

the piston having two piston pin eyelets defining a second center axis;

said second center axis defining a transverse axis;

the piston defining a middle plane containing said longitudinal center axis of the piston;

said middle plane being perpendicular to said transverse axis;

the piston having two piston pockets arranged on opposite sides of said middle plane;

said piston skirt having an edge facing away from said piston base;

the piston defining a circumferential direction;

said edge defining a recess between said two piston pockets;

said piston skirt having a reduced height (I) at said recess; and, said edge having a chamfer at said recess at a radially outer side of the piston.

15. A two-stroke engine comprising:

a piston having a piston base and a piston skirt;

a cylinder having a cylinder bore;

a combustion chamber formed in said cylinder bore and delimited by said piston;

a crankcase;

a crankshaft rotatably mounted in said crankcase;

a connecting rod having a connecting rod eye;

said piston being configured to drive said crankshaft via said connecting rod;

said connecting rod being mounted on said crankshaft via said connecting rod eye;

said piston base having a top side;

said piston skirt defining a first center axis;

said first center axis forming a longitudinal center axis of said piston;

said piston having two piston pin eyelets defining a second center axis;

said second center axis defining a transverse axis;

said piston defining a transverse plane containing said transverse axis and said longitudinal center axis;

said piston defining a middle plane containing said longitudinal center axis of said piston;

said middle plane being perpendicular to said transverse axis;

said piston having two piston pockets arranged on opposite sides of said middle plane;

said piston skirt having an edge facing away from said piston base;

said piston defining a circumferential direction;

said edge defining a recess between said two piston pockets;

said piston skirt having a reduced height (I) at said recess;

said edge having a chamfer at said recess at a radially outer side of said piston;

said transverse plane of said piston defining a first side and a second side lying opposite to said first side;

said connecting rod eye being configured to be disposed on said first side during an upward stroke of said piston; and, said chamfer being arranged on said second side of said transverse plane during an upward stroke of said piston.

16. A piston for a two-stroke engine operating with advanced scavenging, the piston comprising:

a piston base having a top side;

a piston skirt defining a first center axis;

said first center axis forming a longitudinal center axis of the piston;

the piston having two piston pin eyelets defining a second center axis;

said second center axis defining a transverse axis of the piston;

the piston defining a middle plane containing said longitudinal center axis of the piston;

said middle plane being perpendicular to said transverse axis;

the piston having at least one piston pocket arranged completely on a first side of said middle plane;

the piston having a piston pin receptacle defining a receptacle longitudinal center axis;

the piston defining a transverse plane containing said receptacle longitudinal center axis and said longitudinal center axis of the piston;

said piston including at least one first rib having a first thickness (o) at said piston skirt;

said piston including at least one second rib having a second thickness (n); and, said first thickness (o) being greater than said second thickness (n).

17. The piston of claim 16, wherein said thickness (o) is 1.1 to 1.8 times greater than said thickness (n).

18. The piston of claim 16, wherein said at least one first rib and said at least one second rib have different heights.

19. The piston of claim 16, wherein:

said piston skirt has a top side;

said at least one second rib has a second rib tip arranged at a side of said at least one second rib facing away from said top side of said piston skirt;

said second rib tip is at a distance (f) to said top side;

said at least one first rib has a first rib tip facing away from said top side of said piston skirt;

said first rib tip is at a distance (g) to said top side; and, said distance (g) is 1.1 to 1.5 times as great as said distance (f).

20. The piston of claim 19, wherein:

the piston has a height (h); and, said distance (g) is 50% to 80% of said height (h).

21. The piston of claim 19 wherein:

the piston has a height (h); and, said distance (f) is 30% to 70% of said height (h).

* * * * *